US007871473B2

(12) United States Patent
Lebold et al.

(10) Patent No.: US 7,871,473 B2
(45) Date of Patent: Jan. 18, 2011

(54) AUTOMATIC COMPRESSOR STAGE CLEANING FOR AIR BOOST SYSTEMS

(75) Inventors: Robert S. Lebold, Weaverville, NC (US); Steve Roby, Asheville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 277 days.

(21) Appl. No.: 11/857,107

(22) Filed: Sep. 18, 2007

(65) Prior Publication Data

US 2009/0133718 A1 May 28, 2009

Related U.S. Application Data

(60) Provisional application No. 60/826,236, filed on Sep. 20, 2006.

(51) Int. Cl.
*B08B 3/04* (2006.01)

(52) U.S. Cl. ..... 134/56 R; 134/57 R; 134/123; 134/184

(58) Field of Classification Search ..... 123/198 A; 134/56 R
See application file for complete search history.

(56) References Cited

U.S. PATENT DOCUMENTS 4,530,338 A 7/1985 Sumi
4,548,040 A * 10/1985 Miller et al. ..... 60/619
4,705,463 A 11/1987 Joco
4,991,562 A 2/1991 Chujo
5,125,377 A * 6/1992 Mezheritsky ..... 123/198 A
5,399,064 A 3/1995 Church et al.
5,944,483 A 8/1999 Beck et al.
6,164,931 A 12/2000 Norton et al.

* cited by examiner

*Primary Examiner*—Michael Kornakov
*Assistant Examiner*—Natasha Campbell
(74) *Attorney, Agent, or Firm*—Patent Central LLC; Stephan A. Pendorf; William G. Anderson

(57) ABSTRACT

A method and device for maintaining air boost system performance is provided. One or more stages of the air boost system can be connected by tubing to a cleaning system that includes a fluid reservoir (135, 235) containing cleaning fluid and a means of conveying the cleaning fluid into at least one stage of the air boost system. The air boost system can also include a means for detecting (150, 250) at least one fouling parameter of said air boost system. Mien the fouling parameter meets a pre-determined condition, a control means (155, 255) can trigger the cleaning means and inject cleaning fluid into the stage or stages to be cleaned.

7 Claims, 4 Drawing Sheets

AUTOMATIC COMPRESSOR STAGE CLEANING FOR AIR BOOST SYSTEMS

CROSS REFERENCE TO RELATED APPLICATIONS

This application is related to and claims priority in, U.S. Provisional Application Ser. No. 60/826,236, filed Sep. 20, 2006, the disclosures of which is incorporated herein by reference.

TECHNICAL FIELD

This invention relates to a method and device for maintaining air boost system performance at peak levels and removing deposits from the compressor stage of an air boost systems and other similar systems.

BACKGROUND OF THE INVENTION

Air boost systems, such as turbochargers and superchargers, have long been used to increase engine power in many applications including powering on-highway trucks, boats, large ships and, more recently, automobiles. In general, engine power is linked to engine displacement. Thus, a significant increase in power generally requires designing and fabricating a more expensive engine that is significantly larger and heavier. Air boost systems that are smaller and lighter can provide the same increase in engine power at a lower cost. The design and function of turbochargers is described in detail in the prior art, for example, U.S. Pat. Nos. 4,705,463, 5,399,064, and 6,164,931, the disclosures of which are incorporated herein by reference. The design and function of superchargers is also described in the prior art, for example, U.S. Pat. Nos. 4,530,338 and 4,991,562, the disclosures of which are incorporated herein by reference.

Air boost systems include a compressor stage that is upstream of the engine intake manifold. The compressor stage includes a compressor housing, which has an inlet and an outlet, and encloses a compressor rotor. The compressor rotor is attached to a shaft that is typically driven either by the engine, in the case of a supercharger, or by exhaust gas from the engine, in the case of a turbocharger. As the compressor rotor rotates, it increases the mass flow rate and pressure of the air entering the engine. Since the same volume of air at a higher pressure contains more oxygen per volume than ambient air, the air boost system enables to engine to combust more fuel, thereby generating more power, for a given engine displacement.

Rotating at speeds of up to 300,000 RPM and designed to operate for 200,000 and more miles, the compressor stage handles extremely large volumes of air. Air drawn from the atmosphere into the compressor contains very fine particles such as dust, pollen, oil, smoke, dirt, and other contaminants. Although filters are commonly used to clean the air, even the best filters cannot completely prevent particles from entering the compressor and producing deposits on the compressor rotor, compressor housing, intercooler, downstream piping, and other downstream components. This problem of deposits accumulating on air boost system components is referred to as fouling.

The problem of compressor side fouling has been aggravated in recent years as a result of the evolving awareness of the impact of engine emissions on the environment. This awareness led to the development of closed crankcase ventilation systems that recycle engine gases instead of venting blow-by to the atmosphere. The closed crankcase ventilation systems filter the engine gases and reintroduce them upstream of the compressor. Even after the blow-by has been filtered it may still contain oil vapor and other contaminants that result in fouling on the air boost system components.

In the initial phase of the fouling problem, an increased surface roughness of the compressor rotor may affect the behavior of the boundary layer air interacting with the rotor. As the airflow through the compressor stage becomes more turbulent and the compressor become less efficient. This inefficiency causes an increase in fuel consumption and a loss in power generation output.

Government mandated improvements in fuel economy, power ratings and emissions performance for engines, and particularly for commercial diesel applications, has resulted in a need for air boost systems capable of producing increased pressure ratios. This compounds the problems outlined above in two ways. First, the increased pressure ratios require increased mass flow rates thereby increasing the mass of contaminants that pass through the air boost system. Second, maintaining high efficiencies is critical to achieving the elevated pressure ratios.

It is therefore necessary to remove fouling from the air boost system to deliver air at the optimal pressure to the engine. It is known to remove fouling from the air boost system by removing and disassembling the air handling system and then scraping the deposits off of the system components. However, this method of cleaning is expensive in terms of both labor costs and vehicle down time.

Methods have been developed for wet cleaning of the nozzle rings of an exhaust-gas turbocharger turbine by injecting cold water immediately upstream of the nozzle rings and thermally shocking the contaminants. For example, U.S. Pat. No. 5,944,483, entitled "Method and Apparatus for the Wet Cleaning of the Nozzle Ring of an Exhaust-Gas Turbocharger Turbine" to Beck at al. However, this method requires maintenance of a separate cleaning system and relies predominantly on thermal shock to achieve cleaning. Unlike the turbine stage of a turbocharger, portions of the compressor stage of an air boost system, particularly the intercooler and piping downstream of the intercooler, are not hot enough to rely on thermal shock for contaminant removal. Thus, it is desirable to develop a device and method for cleaning air boost systems that is inexpensive, that does not rely on thermal shock cleaning, and that does not require vehicle down time or a separate cleaning system.

Systems have been developed for cleaning the turbine blades of a turbocharger by supplying atomized water under high pressure to the exhaust gas powering the turbocharger. For example, U.S. Pat. No. 4,548,040, entitled "Method and Apparatus for Determining When to Initiate Cleaning of Turbocharger Turbine Blades" to Miller et al. Like the method of cleaning nozzle rings above, the Miller approach require maintenance of a separate cleaning system and cleans the turbine stage where water and elevated temperatures make thermal shock cleaning effective. Thus, it is desirable to develop a device and method for cleaning air boost systems that is inexpensive, that does not rely on thermal shock cleaning, and that does not require vehicle down time or a separate cleaning system.

The need to find a simple, low-cost device or method of maintaining air boost system efficiency is particularly pronounced in some engine markets, such as the automobile market. Since space under the hood is at a premium in the automobile market, one would expect to see extensive use of air boost systems in the automobile market. However, experience tells us that this is not the case. Unlike markets such as the trucking industry and the shipping industry where air boost systems are commonplace, the majority of automobile consumers are extremely sensitive to initial vehicle costs, maintenance costs, and vehicle down time. Because of these issues, automobiles with air boost systems are generally limited to high-end cars and sports cars where the consumer is willing to deal with the present drawbacks in exchange for performance. Thus, in order for the masses to reap the benefits of air boost systems, it is desirable to develop an inexpensive device or method for cleaning air boost systems that is simple to maintain, small enough to fit under the hood of current automobiles, and avoids taking the vehicle out of service.

SUMMARY OF THE INVENTION

The present invention overcomes the deficiencies of the prior art to deliver an automated system for cleaning an air boost system that does not require any disassemble and is inexpensive, simple to maintain, and requires little, or no, additional space in the engine compartment. Delivering a cleaning fluid into the air boost system stage that requires cleaning yields this surprising result. In addition, with only minimal modifications, the windshield washer fluid system already present in cars can be used to store the cleaning fluid and convey it into the air boost system stage that needs cleaning. While this invention may be practiced with a separate fluid storage and conveyance system, the windshield washer system embodiment requires neither new components nor additional space in the engine compartment.

One embodiment of the present invention is an air boost system cleaning system that may include a compressor stage, a turbine stage, or both. One or more stages of the air boost system are connected by tubing to a cleaning system that includes a fluid reservoir containing cleaning fluid and a means of conveying the cleaning fluid into at least one stage of the air boost system. The air boost system also includes a means for detecting at least one fouling parameter of said air boost system. Finally, if the fouling parameter meets a predetermined condition, a control means will trigger the cleaning means and inject cleaning fluid into the stage or stages to be cleaned.

Depending on the method employed, the means for detecting the fouling parameters may be disposed within the compressor outlet, between the compressor outlet and the engine intake manifold, within the turbine stage of the air boost system, or within the passenger cabin of the vehicle.

Another embodiment of the present invention is an air boost system that includes a compressor housing, having a compressor inlet and a compressor outlet, and a cleaning fluid inlet located in the compressor inlet. The air boost system also includes a compressor rotor disposed within the compressor housing, where the compressor rotor is attached to a shaft that is connected to a means for driving the shaft. The system further includes a reservoir containing a cleaning fluid that is connected to a means for conveying the cleaning fluid, where the means for conveying cleaning fluid is connected to the cleaning fluid inlet.

Another embodiment of the present invention is a method that includes sensing a fouling parameter of an air boost system and comparing the fouling parameter with a predetermined condition of the fouling parameter. If the fouling parameter meets the pre-determined condition, a signal is generated that triggers a means of conveying cleaning fluid into one or more stages of the air boost system for a period of time sufficient to reduce deposits on the compressor stage.

The cleaning fluid in any of the previously described embodiments may be windshield washer fluid. Furthermore, the cleaning fluid reservoir may be the reservoir used to store windshield washer fluid used in the system already employed for washing the windshield.

The means for conveying cleaning fluid in any of the previously described embodiments may be a pump driven by an electric motor. Furthermore, the pump may be the same pump used to convey windshield washer fluid in the system already employed for washing the windshield.

Finally, any of the previously described embodiments may use windshield washer fluid as the cleaning fluid, and the reservoir and pump already employed by the windshield washing system as the cleaning fluid reservoir and means for conveying cleaning fluid, respectively.

BRIEF DESCRIPTION OF THE DRAWINGS

A more complete appreciation of the invention and many of the attendant advantages thereof will be readily understood by reference to the following detailed description when considered in connection with the following drawings.

FIG. 3.*b*. shows a schematic view of a high-pressure fluid system used as the cleaning fluid conveying system according to the present invention.

Figure 1:
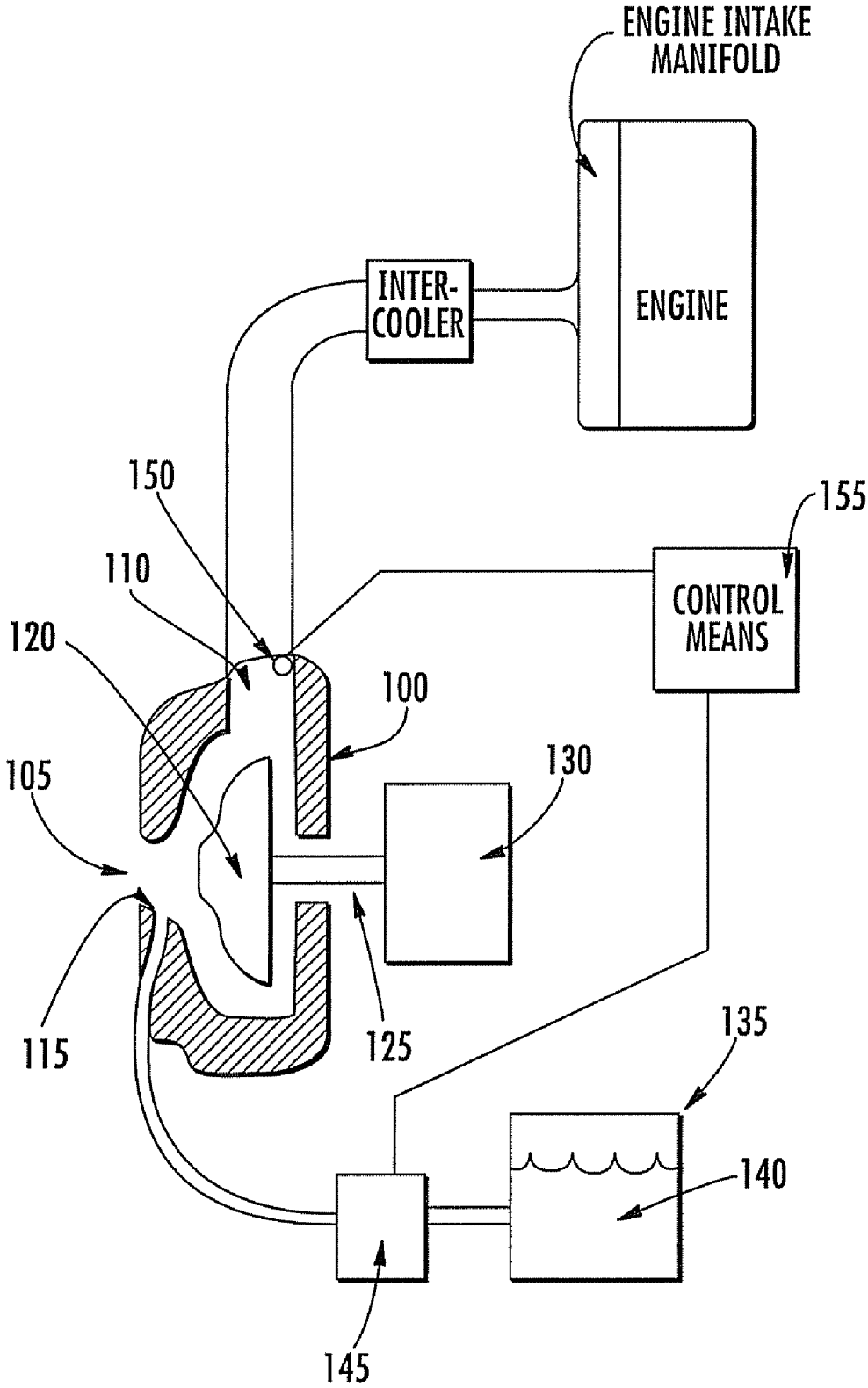
FIG. 1 shows a schematic of a compression stage cleaning system according to the present invention.
Figure 2:
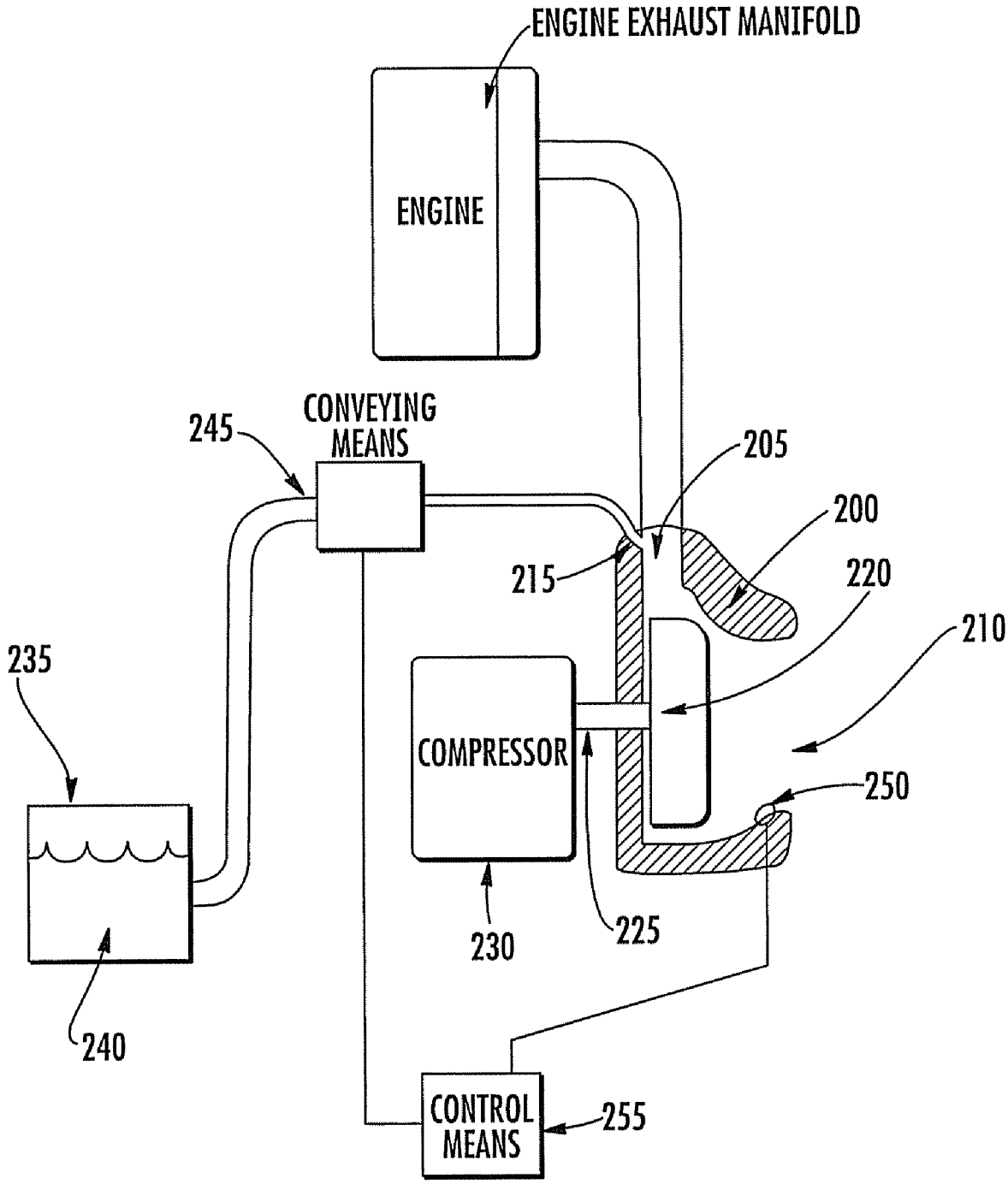
FIG. 2 shows a schematic of a turbine stage cleaning system according to the present invention.

Only the elements essential for understanding the invention are shown, For example, neither the internal-combustion engine, nor a detailed view of the bearing assembly, is shown.

DESCRIPTION OF THE PREFERRED EMBODIMENTS

The apparatus and method set forth herein are described relative to use in cleaning the compressor stage or turbine stage of an air boost system. It is to be understood that this invention has applicability to any stage of an air boost system, or similar system, wherein a fouling parameter indicative of diminished performance of the stage may be sensed and used to initiate a cleaning operation.

As used herein, the term "air boost system" refers to any system (1) used to increase the pressure of the gases entering the an internal combustion engine or (2) powered by the exhaust gases of an internal combustion engine. Common examples include the compression and turbine stages of an exhaust gas powered turbocharger and the compression stage of a mechanically powered supercharger. One skilled in the art will appreciate that the present invention may be equally applicable to similar apparatuses that handle large volumes of gases containing contaminants.

As used herein, the term "fouling parameter" refers to any parameter that may indicate the need to clean the air boost system. Fouling parameters include, but are not limited to, reduced pressure in the compression stage, elapsing of a specified period of time, operator generated input, or an engine operation milestone, such as vehicle mileage or hours in use. One skilled in the art will appreciate that other fouling parameters may be used to detect diminished performance of an air boost system.

As used herein, the term "compressor stage" refers to all components from the compressor inlet up to, and including, the engine intake manifold. This includes, but is not limited to, the compressor rotor, the compressor housing, the compressor diffuser, the engine intake manifold, and the intercooler, connecting piping and other components downstream of the compressor outlet.

As used herein, the term "turbine stage" refers to all components from the engine exhaust manifold up to and including, the turbine outlet. This includes, but is not limited to the engine exhaust manifold, the connecting piping, the turbine housing, the turbine rotor, and other systems downstream of the engine exhaust manifold.

As used herein, the term "cleaning sequence" refers to a series of at least one injections of cleaning fluid into a stage of an air boost system. As part of a cleaning sequence, the number, length, and time between injections of cleaning fluid may be varied. As will be appreciated by one skilled in the art, these variable may be varied to achieve optimum cleaning of the stage being cleaned.

Cleaning fluids used for cleaning a component of an air boost system should be highly wettable, have a high cleaning efficiency, and leave minimal residue upon evaporation The cleaning fluid should not require rinsing the surfaces after cleaning.

Windshield washer formulations are formulated from organic solvents, surfactants and emulsifiers to remove grease, oil, soot and other deposits commonly found on glass surfaces. Many windshield washer formulations are also water-based, non-corrosive, non-flammable, and environmentally friendly. The components of an air boost system are exposed to many of the same contaminants as windshields and are subject to corrosion.

As used herein, the term "cleaning fluid" refers to conventional cleaning solutions and a variety of detergent solutions. Cleaning fluids include, but are not limited to, glass cleaner, windshield washer fluid, and dilute solutions of liquid soap. More generally, cleaning fluids are detergent containing solutions that include one or more of the following: ammonia, vinegar, water, surfactants, enzymes, oxidants, organic solvents, fluorinated hydrocarbons, ethylene glycol and glycol ethers, and alcohols, including methyl alcohol and isopropyl alcohol. One skilled in the art will appreciate that there are many cleaning fluids that may be used within the scope of the present invention.

One general embodiment of the present invention is an air boost system cleaning system that may include a compressor stage, a turbine stage, or both, One or more stages of the air boost system may be connected to a cleaning system that includes a fluid reservoir containing cleaning fluid and a means of conveying the cleaning fluid into the air boost system stages that are connected to the cleaning system. A fouling parameter will be monitored and, if the fouling parameter meets a pre-determined condition, the conveying means is triggered to start a cleaning sequence.

Another embodiment of the present invention is an air boost system cleaning system that includes a compressor housing 100, having a compressor inlet 105 and a compressor outlet 110, and at least one cleaning fluid inlet 115 located in the compressor inlet. The air boost system also includes a compressor rotor 120 disposed within the compressor housing, where the compressor rotor is attached to a shaft 125 that is connected to a means for driving the shaft 130. The system further includes a reservoir 135 containing a cleaning fluid 140 that is connected to a means for conveying the cleaning fluid 145. The means for conveying fluid 145 is connected to the cleaning fluid inlet 115. The air boost system may also include a means for detecting 150 a fouling parameter of the air boost system. The means for detecting 150 a fouling parameter is communicably connected to a control means 155. The control means is communicably connected to the conveying means 145 such that, if the fouling parameter meets a pre-determined condition, the control means will introduce cleaning fluid through the cleaning fluid inlet 115 as part of a cleaning sequence.

As will be appreciated by one skilled in the art, a similar cleaning system may be employed to clean the turbine stage of a turbocharger. Such an embodiment includes a turbine housing 200, having a turbine inlet 205 and a turbine outlet 210, and at least one cleaning fluid inlet 215 located in the turbine inlet. The air boost system also includes a turbine rotor 220 disposed within the turbine housing. The turbine rotor is attached to a shaft 225 that is connected to the compressor side of the turbocharger 230. The system further includes a reservoir 235 containing a cleaning fluid 240 that is connected to a means for conveying the cleaning fluid 245. The means for conveying fluid is connected to the cleaning fluid inlet 215. The air boost system may also include a means for detecting 250 a fouling parameter of the air boost system. The means for detecting 250 a fouling parameter is communicably connected to a control means 255. The control means is communicably connected to the conveying means 245 such that, if the fouling parameter meets a pre-determined condition, the control means will introduce cleaning fluid through the cleaning fluid inlet 215 as part of a cleaning sequence.

In the above embodiments, the cleaning fluid reservoir is connected to the means for conveying cleaning fluid, which is connected to the cleaning fluid inlet. These connections are made such that the cleaning fluid may be transported from the cleaning fluid reservoir and introduced into the air boost system through the cleaning fluid inlet. As will be appreciated by one skilled in the art, the size and type of connection used will vary depending on the desired fluid delivery rate and the environmental conditions that the connections will be exposed to, among other considerations. The connection will generally be some form of tubing, although other alternatives are possible.

In the above embodiments, the means for detecting a fouling parameter is communicably connected to a control means, which is communicably connected to the means for conveying cleaning fluid. Although this connection will typically be a wire, other connections that rely on other types of communications, such as wireless and mechanical means, are also possible.

The above embodiments describe systems where the means for detecting a fouling parameter is disposed within the compressor outlet or turbine outlet. These are but two embodiments of the present invention. Without deviating from the scope of the invention, the means for detecting fouling parameters may be disposed in many places including, but not limited to, within the compressor outlet, between the compressor outlet and the engine intake manifold, within the turbine stage of the air boost system, or within the passenger cabin of the vehicle.

In one embodiment of the present invention the cleaning fluid is windshield washer fluid. In yet another embodiment, the cleaning fluid reservoir is the reservoir used to store windshield washer fluid used in the system already employed for washing the windshield.

Figure 3A:
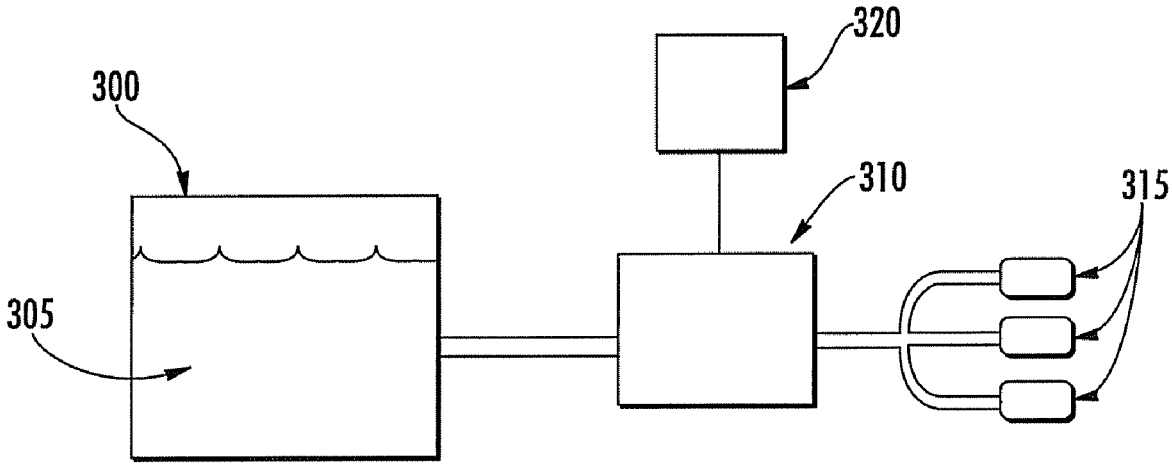
FIG. 3.*a*. shows a schematic view of a pump used as the cleaning fluid conveying system according to the present invention.
Figure 3B:
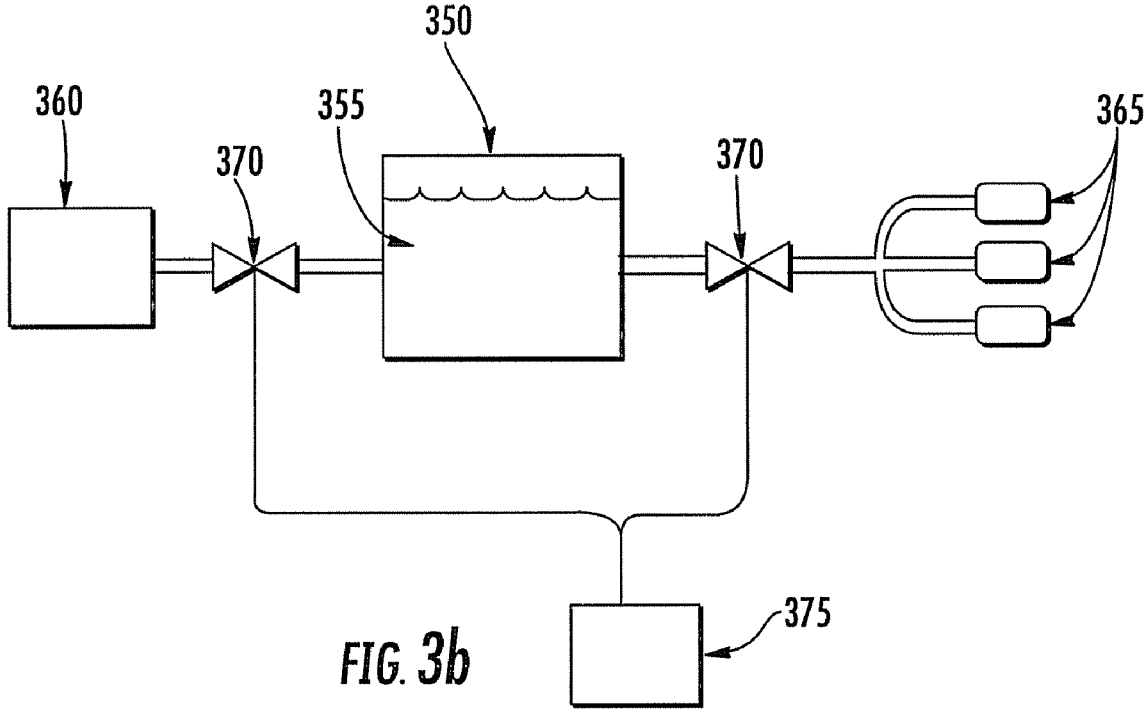

There are many methods of conveying fluid; however, two methods of interest are electrically powered pump and a closed system that relies on high-pressure gas. FIG. 3.*a*. shows the fluid conveying portion of the cleaning system where the means of conveying cleaning fluid is an electrically powered pump. That embodiment relies on a cleaning fluid reservoir 300 containing cleaning fluid 305. The reservoir is connected to an electrical pump 310, for example, the type of pump typically used to convey windshield washer fluid. The outlet of the electrical pump is connected to one or more cleaning fluid inlets 315. The control means 320 is communicably connected to the electrical pump so that it can trigger the pump to start a cleaning sequence when the fouling parameter meets a pre-determined condition.

FIG. 3.*b*. shows the fluid transport portion of the cleaning system where the means of conveying cleaning fluid utilizes a high-pressure gas. That embodiment relies on a pressurized cleaning fluid reservoir 350 containing cleaning fluid 355. A source of high-pressure gas 360 is connected to the cleaning fluid reservoir. One source of high-pressure gas is the compressor stage of an air boost system. The cleaning fluid reservoir is connected to the cleaning fluid inlet 365 so that cleaning fluid may be expressed through the inlet. Solenoid valves 370 or other similar devices may be used to control the high-pressure lines leading to the cleaning fluid reservoir and the cleaning fluid inlet. The solenoid valves or other control devices are communicably connected to the control means 375 so that when the fouling parameter meets a pre-determined condition the valves are opened as part of a cleaning sequence.

In yet another embodiment of the present invention, the cleaning fluid may be windshield washer fluid and the means of conveying cleaning fluid is the electrically powered pump already employed for conveying windshield washer fluid during a driver triggered windshield washing sequence.

In the present invention, the means for detecting a fouling parameter include, but are not limited to, pressure sensors, temperature sensors, flow sensors, and user actuators, such as those commonly used to activate vehicular windshield wiper cleaning sequences. Many turbocharged engines are equipped with fuel or energy control systems which measure and output a variety of operating parameters indicative of overall engine performance. Included in such control systems are highly accurate pressure sensing devices or systems. For example, pressure measuring systems are described in U.S. Pat. No. 4,322,977 entitled "Pressure Measuring System" filed May 27, 1980 in the names of Robert C. Sell, et al.; U.S. Pat. No. 4,434,664 issued Mar. 6, 1984, entitled "Pressure Ratio Measurement System", in the names of Frank J. Antonazzi, et al.; U.S. Pat. No. 4,422,335 issued Dec. 27, 1983, entitled "Pressure Transducer" to Ohnesorge, et al.; U.S. Pat. No. 4,449,409, issued May 22, 1984, entitled "Pressure Measurement System With A Constant Settlement Time", in the name of Frank J. Antonazzi; U.S. Pat. No. 4,457,179, issued Jul. 3, 1984, entitled "Differential Pressure Measuring System", in the names of Frank J. Antonazzi, et al.; and U.S. Pat. No. 4,422,125, issued Dec. 20, 1983, entitled "Pressure Transducer With An Invariable Reference Capacitor", in the names of Frank J. Antonazzi, et al. The disclosures of the above-identified patents are hereby expressly incorporated by reference herein and include a full and complete understanding of the operation of the invention. One skilled in the art will recognize that this list of potential detection devices is not exhaustive and that other means for detecting fouling parameters may be used without deviating from the scope of the present invention.

While the number of cleaning fluid inlets is not specified, one skilled in the art will recognize that the number of inlets used is a design choice that will depend on the particular application. While many types of nozzles will adequately inject the cleaning fluid into the target portion of the compression stage, one embodiment uses atomizing nozzles as the cleaning fluid inlets. Furthermore, the cleaning fluid inlets may extend into the compressor housing or turbine housing of the air boost system so that cleaning solution is applied directly onto the rotor or some other component of the relevant stage of the air boost system.

The present invention also includes a control means designed to detect when a cleaning cycle is required and to send a signal to the cleaning fluid conveying means to generate a cleaning cycle. An electronic control unit (ECU) containing compressor map data is generally used to control modern air boost systems. The compressor map can be used to determine the air boost system efficiency based on the pressure ratio and the air flow requirements of the engine.

One embodiment of the present invention contemplates storing a plurality of compressor maps in the ECU's central processing unit. Each map constitutes a control signal means for (1) storing a plurality of control signals each having a predetermined value of one of the parameter sensed; and (2) generating said control signal in response to an input signal or signals. The ECU can determine when the fouling parameter meets a pre-determined condition, including pressure or temperature, and respond by sending a signals to the cleaning fluid conveying means to triggers a cleaning sequence.

Another embodiment of the present invention is a method of removing deposits from at least one stage of an air boost system. The method includes, detecting a fouling parameter of the air boost system, comparing the fouling parameter with a pre-determined condition of the fouling parameter, and generating a signal when the detected fouling parameter meets the pre-determined condition. The method further includes, responding to the signal by conveying cleaning fluid into the stage, or stages, of the air boost system for a period of time sufficient to reduce deposits within the stage, or stages.

Figure 4:
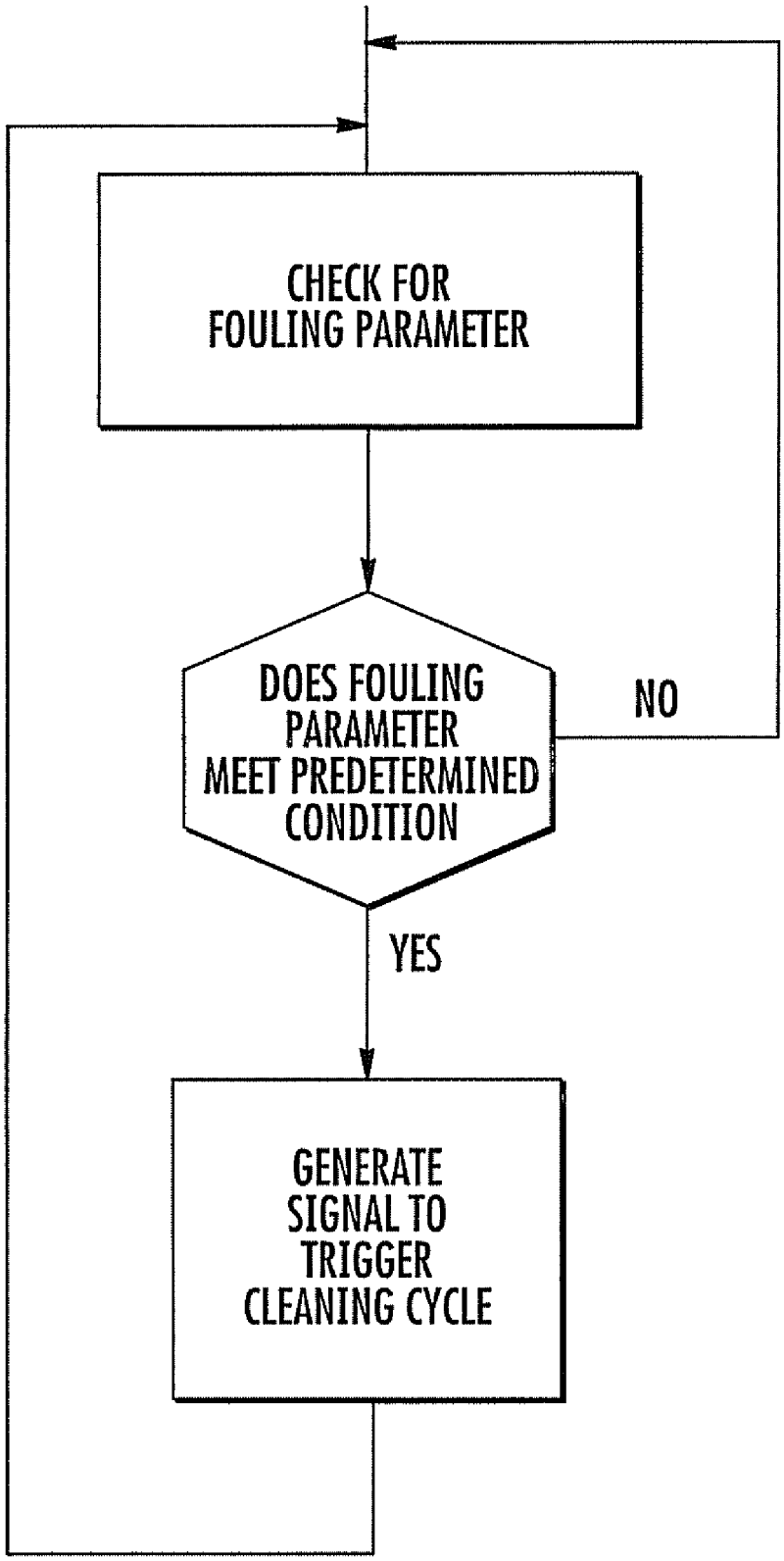
FIG. 4 is a flow chart of outlining the logic used to detect when to initiate a cleaning sequence as part of the present invention.

FIG. 4 shows one possible flow chart depicting the control logic for a method of the present invention. The first step is to detect the fouling parameter 400. Next, the control means will compare the detected fouling parameter to the pre-determined fouling parameter condition 410. If the fouling parameter does not meet the pre-determined fouling parameter condition 420 then the control means with start at the beginning and detect the fouling parameter 400 again. If the fouling parameter meets the pre-determined fouling parameter condition 430 then the control means will generate a signal to trigger a cleaning cycle 440. Once the cleaning cycle is completed, the control means will return to the start 450 and detect the fouling parameter 400 again.

Obviously, numerous modifications and variations of the present invention are possible. It will be appreciated by one skilled in the art that, within the scope of the appended claims, the invention may be practiced otherwise than as specifically described herein.

What is claimed is:

1. A motor vehicle air boost system with a cleaning system comprising:

an air boost system comprising a compressor housing having a compressor inlet and a compressor outlet, and a compressor rotor located in said compressor housing;

a cleaning means comprising a reservoir, a cleaning fluid disposed in said reservoir, tubing connecting said reservoir to said compressor housing inlet, and a means for conveying said cleaning fluid in said tubing;

a detecting means for detecting at least one fouling parameter of said air boost system; and a control means adapted to trigger said cleaning means to inject cleaning fluid into said compressor inlet in response to detection of said fouling parameter wherein said means for conveying cleaning fluid is a pump driven by an electric motor of the motor vehicle, adapted to provide cleaning fluid to a windshield of the vehicle from said reservoir.

2. The cleaning system of claim 1, wherein said detecting means is located in said compressor outlet or downstream thereof.

3. The cleaning system of claim 1, wherein said cleaning fluid is a windshield washer fluid.

4. A motor vehicle air boost system with a cleaning system comprising:

an air boost system comprising a turbine housing having a turbine inlet and a turbine outlet, and a turbine rotor located in said turbine housing;

a cleaning means comprising a reservoir, a cleaning fluid disposed in said reservoir, tubing connecting said reservoir to said turbine housing inlet, and a means for conveying said cleaning fluid in said tubing, a detecting means for detecting at least one fouling parameter of said air boost system, and a control means adapted to trigger said cleaning means to inject cleaning fluid into said turbine inlet in response to detection of said fouling parameter wherein said means for conveying cleaning fluid is a pump driven by an electric motor of the motor vehicle adapted to provide cleaning fluid to a windshield of the vehicle from said reservoir.

5. The cleaning system of claim 4, wherein said cleaning fluid is a windshield washer fluid.

6. The cleaning system of claim 1, wherein said motor vehicle air boost system is a turbocharger.

7. The cleaning system of claim 4, wherein said motor vehicle air boost system is a turbocharger.

* * * * *